US007642444B2

(12) United States Patent
Fujishima et al.

(10) Patent No.: US 7,642,444 B2
(45) Date of Patent: Jan. 5, 2010

(54) MUSIC-PIECE PROCESSING APPARATUS AND METHOD

(75) Inventors: Takuya Fujishima, Hamamatsu (JP); Jordi Bonada, Barcelona (ES); Maarten De Boer, Barcelona (ES); Sebastian Streich, Hamamatsu (JP); Bee Suan Ong, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/985,212

(22) Filed: Nov. 13, 2007

(65) Prior Publication Data

US 2008/0115658 A1 May 22, 2008

(30) Foreign Application Priority Data

Nov. 17, 2006 (JP) ..... 2006-311325
Mar. 20, 2007 (JP) ..... 2007-072375

(51) Int. Cl.
*G10H 1/22* (2006.01)

(52) U.S. Cl. ..... 84/618; 84/600; 84/609; 84/613; 84/615; 84/622

(58) Field of Classification Search ..... 84/600, 84/609, 618, 622, 613, 637, 615
See application file for complete search history.

(56) References Cited

U.S. PATENT DOCUMENTS 5,760,325 A * 6/1998 Aoki ..... 84/613
5,877,445 A 3/1999 Hufford et al.
5,918,223 A * 6/1999 Blum et al. ..... 707/1
6,096,960 A * 8/2000 Scott ..... 84/603
6,487,536 B1 * 11/2002 Koezuka et al. ..... 704/500
2003/0065517 A1 4/2003 Miyashita
2003/0081859 A1 * 5/2003 Kasutani ..... 382/305
2004/0055447 A1 * 3/2004 Childs et al. ..... 84/615
2005/0098023 A1 * 5/2005 Toivonen et al. ..... 84/615
2005/0132870 A1 * 6/2005 Sakurai et al. ..... 84/612
2006/0032363 A1 * 2/2006 Platt ..... 84/601
2007/0113724 A1 * 5/2007 Kim et al. ..... 84/609

(Continued)

OTHER PUBLICATIONS

Ari Lazier, Perry Cook: Mosievius: Feature Driven Interactivie Audio Mosaicing (6 pgs.; Aug. 11, 2003).

(Continued)

*Primary Examiner*—Walter Benson
*Assistant Examiner*—Kawing Chan
(74) *Attorney, Agent, or Firm*—Pillsbury Winthrop Shaw Pittman LLP

(57) ABSTRACT

For each of a plurality of music pieces, a storage device stores respective tone data of a plurality of fragments of the music piece and respective musical character values of the fragments. Similarity determination section calculates a similarity index value indicative of a degree of similarity between the character values of each of the fragments of a main music piece and the character values of each individual fragment of a plurality of sub music pieces. Each of the similarity index values calculated for the fragments of each of the sub music pieces can be adjusted in accordance with a user's control. Processing section processes the tone data of each of the fragments of the main music piece on the basis of the tone data of any one of the fragments of the sub music pieces of which the similarity index value indicates sufficient similarity.

18 Claims, 3 Drawing Sheets

U.S. PATENT DOCUMENTS

| | | | | |
|---|---|---|---|---|
| 2007/0261540 | A1* | 11/2007 | Gremo et al. | 84/743 |
| 2007/0291958 | A1* | 12/2007 | Jehan | 381/103 |
| 2008/0072741 | A1* | 3/2008 | Ellis | 84/609 |

OTHER PUBLICATIONS

Bee Suan Ong, Emilia Gomez, Sebastian Streich: Automatic Extraction of Musical Structure Using Pitch Class Distributiodn Features (13 pgs.; 2006).

European Patent Office: Extended European Search Report for Application No. 07120926.6—2225, dated Jan. 25, 2008.

Tristan Jehan: Creating Music by Listening (XP-002464414) (Dated: Sep. 2005).

Diemo Schwarz: A System for Data-Driven Concatenative Sound Synthesis (XP-002464415) (Dated: Dec. 7-9, 2000).

Ari Lazier, Perry Cook: Mosievius: Feature Driven Interactive Audio Mosaicing (XP-002464416) (Dated: Sep. 8-11, 2003).

Aymeric Zils, Francois Pachet: Musical Mosaicing (XP-002464417) (Dated: Dec. 6-8, 2001).

* cited by examiner

MUSIC-PIECE PROCESSING APPARATUS AND METHOD

BACKGROUND

The present invention relates to a technique for processing music pieces.

Disk jockeys (DJs), for example, reproduce a plurality of music pieces one after another while interconnecting the music pieces with no break therebetween. Japanese Patent Application Laid-open Publication No. 2003-108132 discloses a technique for realizing such music piece reproduction. The technique disclosed in the No. 2003-108132 publication allows a plurality of music pieces to be interconnected smoothly by controlling respective reproduction timing of the music pieces in such a manner that beat positions of successive ones of the music pieces agree with one another.

In order to organize a natural and refined music piece from a plurality music pieces, selection of proper music pieces as well as adjustment of reproduction timing of the music pieces becomes an important factor. Namely, even where beat positions of individual music pieces are merely adjusted as with the technique disclosed in the No. 2003-108132 publication, it would not be possible to organize an auditorily-natural music piece if the music pieces greatly differ from one another in musical characteristic.

SUMMARY OF THE INVENTION

In view of the foregoing, it is an object of the present invention to produce, from a plurality of music pieces, a music piece with no uncomfortable feeling.

In order to accomplish the above-mentioned object, the present invention provides an improved music-piece processing apparatus, which comprises: a storage section that stores respective music piece data sets of a plurality of music pieces, each of the music piece data sets comprising respective tone data of a plurality of fragments obtained by segmenting the music piece and respective character values of the fragments, the character value of each of the fragments being indicative of a musical character of the fragment; a designation section that designates, from among the plurality of music pieces stored in the storage section, one music piece as a main music piece and one or more music pieces as sub music pieces; a comparison section that compares the character value of each of the fragments of the main music piece designated by the designation section and the character value of each individual one of the fragments of the one or more sub music pieces designated by the designation section; and a processing section that, on the basis of results of the comparison by the comparison section, processes the tone data of each of the fragments of the main music piece on the basis of the tone data of any one of the fragments, similar in character value to the fragment of the main music piece, of the designated one or more sub music pieces.

In the music-piece processing apparatus arranged in the aforementioned manner, a given one of the fragments of the main music piece is processed on the basis of any one of the fragments the sub music pieces which is similar in musical character to the given fragment of the main music piece. Thus, even where the user is not familiar with similarity and harmoniousness of the individual music pieces, the present invention can produce an auditorily-natural music piece without impairing the tune of the main music piece.

In an embodiment, the comparison section calculates a similarity index value indicative of a degree of similarity, to the character value of each of the fragments of the main music piece, of the character value of each individual one of the fragments of the one or more sub music pieces, and the processing section determines, on the basis of the similarity index value calculated by the comparison section, similarity between the character value of each of the fragments of the main music piece and the character value of each individual one of the fragments of the one or more sub music pieces. Then, the processing section processes the tone data of a given one of the fragments of the main music piece on the basis of the tone data of any one of the fragments of the sub music pieces which has been determined to be similar to the given fragment.

In a more specific embodiment, each of the fragments is a segment obtained by segmenting the music piece at a time point thereof synchronized with a beat. For example, each music piece may be segmented into segments each corresponding to one or more beats (i.e., segmented using one or more beats as a segmentation unit), or an interval between every two adjacent beat of the music piece may be segmented into a plurality of segments (each corresponding to, for example, a time length of a ½ or ¼ beat), and each of such segments may be set as a fragment. Because each of the fragments is set by segmenting the music piece at a time point synchronized with a beat, this embodiment can produce a natural music piece while maintaining the rhythm of the main music piece.

In a preferred embodiment of the present invention, the tone data of a given one of the fragments of the main music piece is replaced with the tone data of any one of the fragments of the sub music pieces which has been determined to be similar to the given fragment of the main music piece. In this embodiment, a novel music piece is organized through simple processing of tone data replacement, and thus, there can be achieved the advantageous benefit that the processing load on the processing section can be lessened. For example, the tone data of a given one of the fragments of the main music piece may be processed (e.g., mixed with the tone data of any one of the fragments of the sub music piece) through a predetermined arithmetic operation using the tone data of the sub music piece fragment.

In a preferred embodiment of the present invention, the processing section processes the tone data of the one of the fragments of the sub music pieces, which should replace the given fragment of the main music piece, so as to have a time length substantially equal to a time length of the given fragment of the main music piece, and then it replaces the tone data of the main music piece fragment with the processed tone data of the sub music piece fragment. With the time length of the sub music piece fragment adjusted to substantially equal that of the main music piece fragment, this embodiment can maintain the rhythm of the main music piece more reliably.

In one embodiment, the music-piece processing apparatus further comprises a coefficient setting section that sets a coefficient for each of the one or more sub music pieces in response to operation by a user, and the comparison section includes an adjustment section that adjusts the similarity index values, calculated for the fragments of each of the sub music pieces, in accordance with the coefficient set by the coefficient setting section for the sub music piece. The processing section determines, on the basis of the similarity index values adjusted by the adjustment section, similarity between the character value of each of the fragments of the main music piece and the character value of each individual one of the fragments of the one or more sub music pieces. With the similarity index values of the individual fragments adjusted per sub music piece in accordance with the coefficient set by the coefficient setting section, a frequency at which the sub music pieces are used to process the fragments of the main music piece is increased or decreased in response to operation by the user. As a result, it is possible to organize a variety of music pieces fitting user's intentions.

Note that the specific way for the adjustment section to adjust the similarity index values on the basis of the coefficient set by the coefficient setting section may be chosen as desired. For example, an arithmetic operation section for multiplying the similarity index values, calculated per fragment of the sub music pieces, by the coefficient of the corresponding sub music piece or adding such a coefficient to the similarity index values, may be suitably used as the adjustment section in this embodiment.

Further, although the present invention may employ a construction where all of the fragments of the main music piece are processed on the basis of the fragments of the sub music pieces, the aforementioned construction where only some of the fragments of the main music piece are selectively processed is more preferable in view of the purpose of reliably maintaining the tune of the main music piece. For example, the processing section processes only some of the fragments of the main music piece with respect to which the calculated similarity index values of the fragments of the sub music pieces exceed a predetermined threshold value. In other words, only one or more fragment of the plurality of fragments of the main music piece, which are sufficiently similar to any of the fragments of the sub music pieces, can be selected as fragments to be processed. As a consequence, it is possible to maintain the tune of the main music piece with a sufficient reliability. Further, in the music-piece processing apparatus provided with a designation section that designates each given fragment of the main music piece in response to operation by the user, there may be employed a construction where the processing section does not process each such fragment designated by the designation section from among the plurality of fragments of the main music piece.

According to another aspect of the present invention, there is provided a method of for processing a music-piece using a storage section that stores respective music piece data sets of a plurality of music pieces, each of the music piece data sets comprising respective tone data of a plurality of fragments of the music piece and respective character values of the fragments, the character value of each of the fragments being indicative of a musical character of the fragment, which comprises: a step of designating, from among the plurality of music pieces stored in the storage section, one music piece as a main music piece and one or more music pieces as sub music pieces; a step of comparing the character value of each of the fragments of the main music piece designated by the step of designating and the character value of each individual one of the fragments of the one or more sub music pieces designated by the step of designating; and a step of, on the basis of results of the comparison by the step of comparing, processing the tone data of each of the fragments of the main music piece on the basis of the tone data of any one of the fragments, similar in character value to the fragment of the main music piece, of the designated one or more sub music pieces. This method can achieve generally the same advantageous benefits as the aforementioned music-piece processing apparatus of the invention.

The aforementioned music-piece processing apparatus of the present invention may be implemented not only by hardware (electronic circuitry), such as a DSP (Digital Signal Processor) dedicated to various processing of the invention, but also by cooperative operations between a genera-purpose processor device, such as a CPU (Central Processing Unit), and software programs. Further, the present invention may be implemented as a computer-readable storage medium containing a program for causing the computer to perform the various steps of the aforementioned music-piece processing method. Such a program may be supplied from a server apparatus through delivery over a communication network and then installed into the computer.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION

Figure 1:
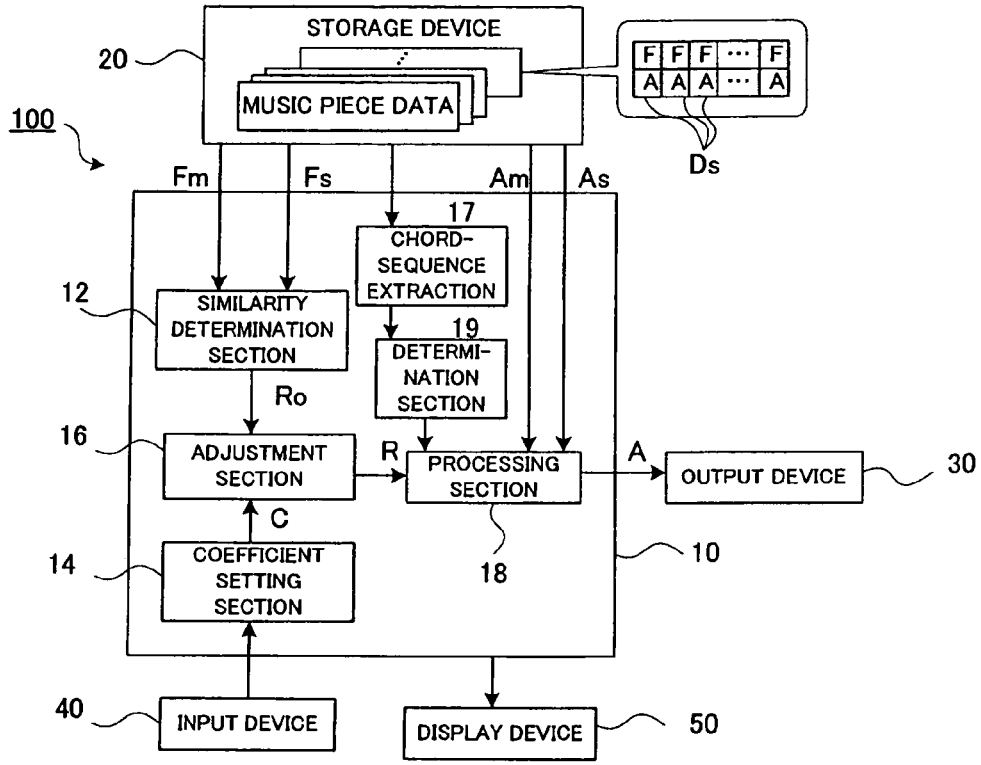
FIG. 1 is a block diagram showing an example general setup of a music-piece processing apparatus in accordance with an embodiment of the present invention.

A. Construction of Music-Piece Processing Apparatus:

FIG. 1 is a block diagram showing an example general setup of a music-piece processing apparatus in accordance with an embodiment of the present invention. This music-piece processing apparatus 100, which is an apparatus designed to process a music piece (hereinafter referred to as "main music piece") using a plurality of music pieces (hereinafter referred to as "sub music pieces"), is implemented by a computer (e.g., personal computer) that includes a control device 10, a storage device 20, an output device 30, an input device 40 and a display device 50, as shown in FIG. 1. In the following description, a suffix "m" is sometime added to reference characters pertaining to the main music piece while a suffix "s" is sometime added to reference characters pertaining to the sub music pieces, to distinguish between the main music piece and the sub music pieces; such suffixes "m" and "s" are not added where it is not necessary to distinguish between the main music piece and the sub music pieces.

The control device 10 is a processing unit (CPU) that controls various components of the music-piece processing apparatus 100 by executing software programs. The storage device 20 stores therein the programs to be executed by the control device 10 and various data to be processed by the control device 10. For example, any of a semiconductor storage device, magnetic storage device and optical disk device can be suitably used as the storage device 20. Further, the storage device 20 stores music data sets of a plurality of music pieces, as shown in FIG. 1.

Figure 2:
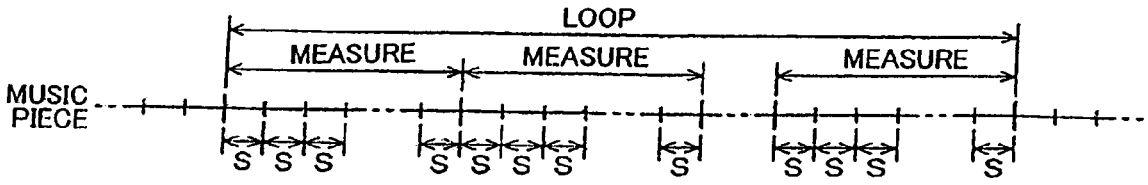
FIG. 2 is conceptual diagram showing relationship between a music piece and fragments of the music piece.

FIG. 2 is conceptual diagram showing an example setup of a music piece. According to the instant embodiment, each music piece is segmented into a multiplicity of measures. As shown in FIG. 2, a section (hereinafter referred to as "loop") comprising a plurality of measures is defined in each music piece. The "loop" is, for example, a characteristic section (e.g., so-called "bridge"), and can be defined by a user operating the input device 40 to designate start and end points of the music piece. In an alternative, the control device 10 may automatically designate, as such a loop, a given section of the music piece which satisfies a predetermined condition.

As further shown in FIG. 2, each measure of each music piece is segmented into a plurality of segments (hereinafter referred to as "fragments") each corresponding to one or more beats (i.e., using one or more beats as a segmentation unit); in the illustrated example, each of the fragments corresponds to one beat. Therefore, in the case of a music piece in duple time, each segment obtained by dividing one measure into two equal segments corresponds to one fragment, in the case of a music piece in triple time, each segment obtained by dividing one measure into three equal segments corresponds to one fragment, and so on. Note that the fragment S may alternatively be a segment obtained by dividing one beat into a plurality of segments (e.g., segment corresponding to ½ or ¼ beat).

As shown in FIG. 1, a music piece data set, corresponding to (i.e., representative of) one music piece, includes fragment data Ds for each of a plurality of fragments S belonging to the loop of the music piece. In a case where three measures of a music piece in quadruple time is designated as a "loop", the music piece data set of the music piece includes a total of 12 fragment data Ds (i.e., three measures four beats=12 fragment data). The fragment data Ds corresponding to one fragment S includes tone data (waveform data) A representative of a sound waveform of each tone belonging to the fragment S, and numerical values F determining musical characters of the fragment S (hereinafter referred to as "character values F"). In the illustrated example, the character values F of the fragment data Ds include numerical values representative of N (N is a natural number) types of character elements of the tone, such as sound energy (intensity), centroid of a frequency-amplitude spectrum, frequency at which spectral intensity becomes the greatest (i.e., frequency presenting a maximum spectral intensity) and MFCC (Mel-Frequency Cepstrum Coefficient); note that the character values F may include numerical values representative of only any one or more, not all, of the N types of character elements.

The control device 10 sequentially outputs tone data while replacing tone data Am of given fragments Sm, belonging to the loop of the main music piece, with tone data As of fragments Ss of sub music pieces which are similar to the given fragments Sm of the main music piece. The output device 30 generates audible tones on the basis of the tone data A sequentially output via the control device 10. The output device 30 includes, for example, a D/A converter that generates an analog signal from each of the tone data A, an amplifier that amplifies the signal output from the D/A converter, and sounding equipment, such as a speaker or headphones, that outputs a sound wave corresponding to the signal output from the amplifier.

The input device 40 is equipment, such as a mouse and keyboard, that includes a plurality of operating members operable by a user. The user can designate or select one main music piece and one or more sub music pieces from among a plurality of music pieces whose music data sets are prestored in the storage device 20. The display device 50 visually displays various images under control of the control device 10.

Next, a description will be given about specific functions of the control device 10. As seen from FIG. 1, the control device 10 functions as a plurality of function-performing sections, such as a similarity determination section 12, coefficient setting section 14, adjustment section 16 and processing section 18, by executing programs stored in the storage device 20. Details of processing performed by the individual function-performing sections are as follows.

The similarity determination section (i.e., comparison section) 12 compares the character values Fm of each fragment Sm of the main music piece and the character values Fs of each individual fragment Ss of each of the sub music pieces, to thereby calculate a numerical value (hereinafter referred to as "similarity index value") R0 indicative of a degree of similarity between the fragment Sm of the main music piece and the fragment Ss of the sub music piece (more specifically, degree of similarity of the fragment character values of the sub music piece to the fragment character values of the main music piece. More specifically, the similarity determination section 12 sequentially reads out, from the storage device 20, the character values Fm of the main music piece in the order the fragments Sm are arranged (i.e., arranged order of the fragments Sm) and calculates, with respect to the character values Fm of each of the fragments Sm, a similarity index value R0 of the character values Fs of each individual one of the fragment Ss of all of the sub music pieces stored in the storage device 20. In order to permit the similarity determination with the character values of N (natural number) types of character elements taken into account, the similarity index value R0 indicative of similarity between the character values Fm and the character values Fs is calculated for example as an inverse number of a distance between two coordinates, corresponding to the character values Fm and character values Fs, set in an N-dimensional space having as its axes N types of character elements included in the character values F. Therefore, it can be said that one given fragment Sm of the main music piece and one given fragment Ss of any one of the sub music pieces are more similar to each other in musical character if the similarity index value R0 calculated therebetween is greater (namely, if their character values Fm and Fs are closer to each other).

Figure 3:
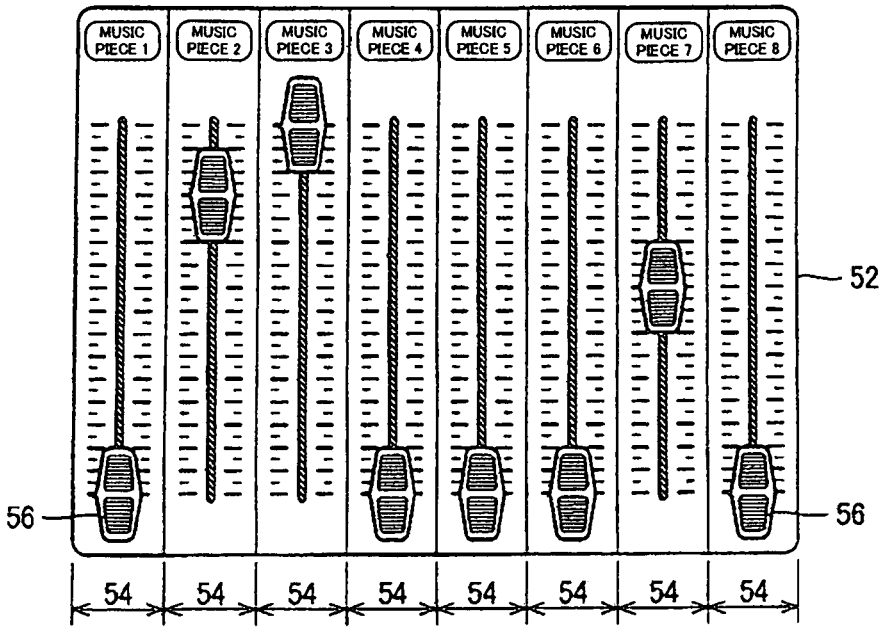
FIG. 3 is a conceptual diagram showing a specific example of a coefficient setting picture displayed on a display device in the embodiment.

The coefficient setting section 14 sets a coefficient C separately per sub music piece. In the instant embodiment, the coefficient setting section 14 separately controls the coefficient C per sub music piece in response to user's operation of the input device 40. FIG. 3 is a conceptual diagram showing a specific example of a picture 52 displayed on the display device 50 for the user to set the coefficients C (hereinafter referred to as "coefficient setting picture 52"). The coefficient setting picture 52 is kept displayed on the display device 50 throughout reproduction of a music piece.

As shown in FIG. 3, the coefficient setting picture 52 includes a plurality of operating member image sections 54 that correspond to different sub music pieces ("music piece 1" to "music piece 8"). Each of the operating member image sections 54 includes an image emulating an operating member (e.g., slider) 56 operable by the user. The user can vertically move any desired one of the operating member 56 by operating the input device 40. For each of the sub music pieces, the coefficient setting section 14 sets a coefficient C corresponding to a current operating position of the operating member 56 corresponding to the sub music piece. In the instant embodiment, the coefficient C is set at zero when the corresponding operating member 56 is at the lower end of the operating member image section 54, and the coefficient C gradually increases in value as the operating member 56 is moved toward the upper end of the operating member image section 54.

The adjustment section 16 can adjust the similarity index value R0, calculated by the similarity determination section 12, for each of the fragment Ss of the sub music pieces. In the instant embodiment, the adjustment section 16 outputs, as a new or adjusted similarity index value R, a product (i.e., result of multiplication) between the similarity index value R0 calculated per fragment Ss of any one of the sub music pieces and the coefficient C set by the coefficient setting section 14 for that sub music piece.

Figure 4:
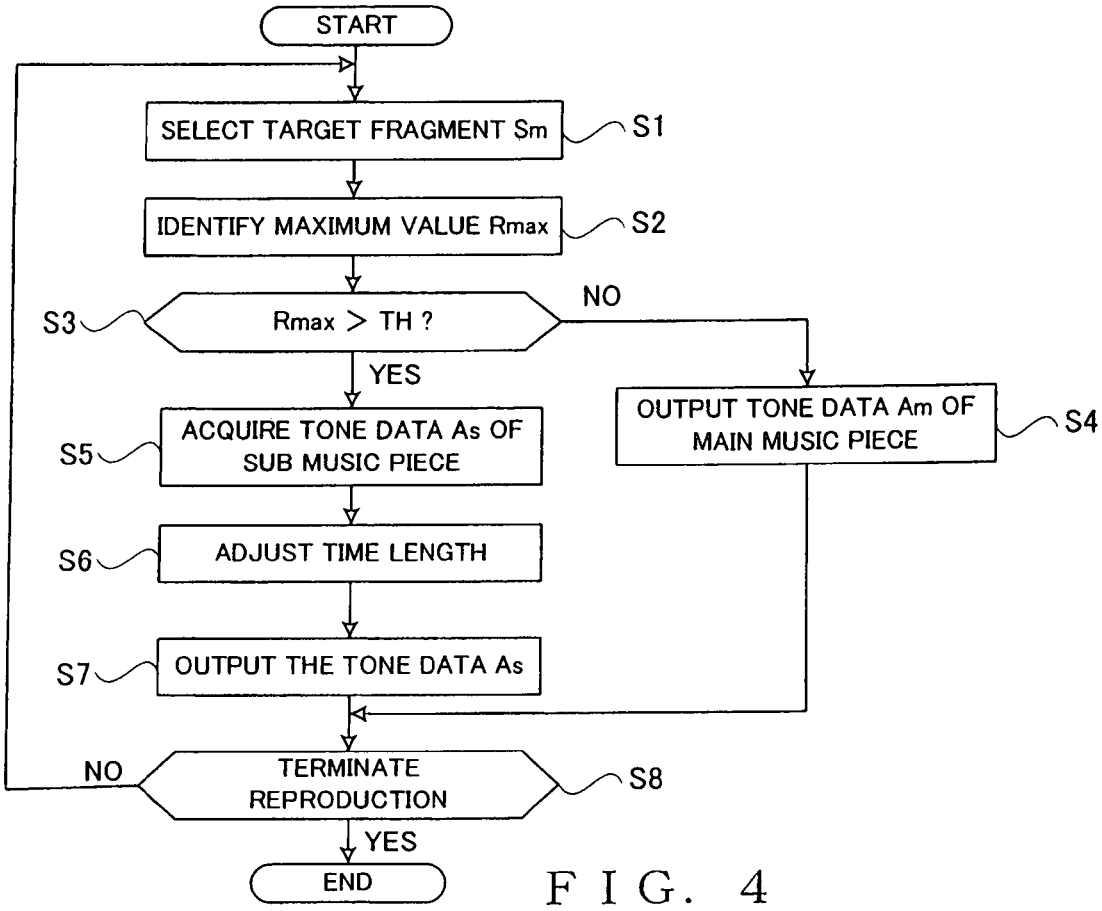
FIG. 4 is a flow chart explanatory of specific processing performed by a processing section in the embodiment.

The processing section 18 replaces the tone data Am of any of the plurality of fragments Sm, constituting the main music piece, with the tone data As of any one of the fragments Ss of the plurality of sub music pieces which is similar to the fragment Sm of the main music piece (i.e., fragment Ss presenting a great similarity index value R); consequently, the thus-replaced and non-displaced tone data are sequentially output via the processing section 18 in a manner as will be later detailed. FIG. 4 is a flow chart explanatory of specific processing performed by the processing section 18. The processing of FIG. 4 is performed each time operation is performed by the user on the input device 40 to instruct the start of reproduction of the main music piece.

First, at step S1, the processing section 18 selects one of the fragments Sm included in the main music piece. Immediately after start of the processing of FIG. 4, the fragment Sm located at the beginning of the loop of the main music piece is selected.

Then, at step S2, the processing section 18 identifies a maximum similarity index value Rmax from among similarity index values R calculated for the individual fragments Ss of the plurality of sub music pieces with respect to the fragment Sm selected at step S1 (hereinafter referred to as "target fragment Sm"). Namely, at step S2, one fragment Ss most similar in musical character to the target fragment Sm is identified from among the fragments Ss of all of the sub music pieces.

At nest step S3, the processing section 18 determines whether or not the maximum similarity index value Rmax exceeds a predetermined threshold value TH. If a negative (or NO) determination has been made at step S3 (i.e., none of the fragments Ss of the plurality of sub music pieces is sufficiently similar to the target fragment Sm), the processing section 18 acquires the tone data Am of the target fragment Sm from the storage device 20 to output the acquired tone data Am to the output device 30, at step S4. Thus, for the current target fragment Sm, a tone of the main music piece is reproduced via the output device 30.

If, on the other hand, an affirmative (YES) determination has been made at step S3 (i.e., any one of the fragments Ss of the plurality of sub music pieces is sufficiently similar to the target fragment Sm), then the processing section 18 acquires, from the storage device 20, the tone data As of the fragment Ss, for which the maximum similarity index value Rmax has been calculated, in place of the tone data Am of the target fragment Sm, at step S5. Further, at step S6, the processing section 18 processes the tone data As, acquired at step S5, in such a manner that the processed tone data As has a time length substantially equal to that of the target fragment Sm of the main music piece. At step S6, it is possible to cause the time length of the processed tone data As to equal the time length of the target fragment Sm of the main music piece while maintaining a tone pitch of the fragment Ss of the sub music piece, using, for example, a conventionally-known technique that adjusts a tempo without changing a pitch of a tone. The processing section 18 outputs the tone data As, having been processed at step S6, to the output device 30, at step S7. Consequently, for the current target fragment Sm, a tone of the fragment Ss of the sub music piece, similar to the target fragment Sm, is reproduced in place of a tone of the main music piece.

Following step S4 or step S7, the processing section 18 makes a determination, at step S8, as to whether operation has been performed by the user on the input device 40 to instruct termination of the reproduction of the music piece. If an affirmative determination has been made at step S8, the processing section 18 brings the processing of FIG. 4 to an end. If, on the other hand, a negative determination has been made at step S8, i.e. if operation has not been performed by the user on the input device 40 to instruct termination of the reproduction of the music piece, the processing section 18 selects, as a new target fragment Sm, another fragment Sm following the current target fragment Sm at step S1 and then performs the aforementioned operations at and after step S2. When the aforementioned operations from step S2 to step S8 have been performed for all of the fragments Sm belonging to the loop of the main music piece before the user instructs termination of the reproduction, the processing section 18 reverts to step S1 to again select, as a new target fragment Sm, the fragment Sm located at the beginning of the loop. Namely, the loop of the main music piece, having been partly replaced with the fragments Ss of the sub music pieces, is reproduced repetitively.

Figure 5:
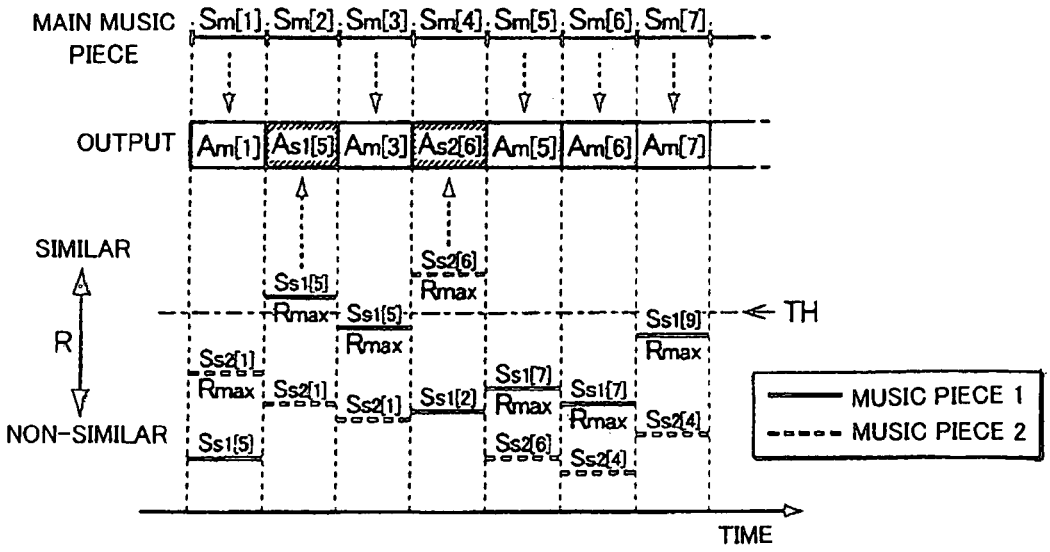
FIG. 5 is conceptual diagram showing relationship between similarity index values and outputs from a control device in the embodiment.

FIG. 5 is a conceptual diagram showing relationship among individual fragments Sm (Sm[1], Sm[2], . . . ) of a main music piece, similarity index values R calculated for individual fragments Ss of a plurality of sub music pieces and tone data A actually output to the output device 30. In the illustrated example of FIG. 5, it is assumed that the sub music piece M1 comprising a plurality of fragments Ss1 (Ss1[1], Ss1[2], . . . ) and the sub music piece M2 comprising a plurality of fragments Ss2 (Ss2[1], Ss2[2], . . . ) are used for processing of the main music piece. In FIG. 5, the similarity index values R (i.e., degrees of similarity to the fragment Sm of the main music piece) are shown as progressively increasing in a bottom-to-top direction of the figure. Further, regarding the similarity index values R, only a maximum value of a plurality of similarity index values R calculated for the individual fragments Ss1 of the sub music piece M1 and only a maximum value of a plurality of similarity index values R calculated for the individual fragments Ss2 of the sub music piece M2 are shown, to avoid complexity of illustration. Referring, for example, to the similarity index values R calculated with respect to the fragment Sm[1] of the main music piece, the similarity index value R of the fragment Ss1[5] is the maximum value among the plurality of fragments Ss1 constituting the sub music piece M1, and the similarity index value R of the fragment Ss2[1] is the maximum value among the plurality of fragments Ss2 constituting the sub music piece M2.

As shown in FIG. 5, the maximum similarity index value Rmax (i.e., the similarity index value R of the fragment Ss2[1] of the sub music piece M2) calculated with respect to the fragment Sm[1] of the main music piece is smaller than the threshold value TH (and thus, a negative or NO determination is made at step S3 in the processing of FIG. 4), so that the tone data Am[1] of the main music piece is output for the fragment Sm[1]. For each of the fragments Sm[3] and Sm[5]-Sm[7] as well, the maximum similarity index value Rmax is smaller than the threshold value TH, so that the tone data Am of the main music piece is output.

Further, of the similarity index values R calculated with respect to the fragment Sm[2] of the main music piece, the similarity index value R of the fragment Ss1[5] of the sub music piece M1 is the maximum similarity index value Rmax, and this maximum similarity index value Rmax is greater than the threshold value TH (and thus, an affirmative or YES determination is made at step S3 in the processing of FIG. 4). Namely, the fragment Ss1[5] of the sub music piece M1 is sufficiently similar to the fragment Sm[2] of the main music piece. Thus, the tone data As1[5] corresponding to the fragment Ss1[5] of the sub music piece M1 is output to the output device 30, in place of the tone data Am[2] of the fragment Sm[2] of the main music piece, after having been subjected to the time length adjustment (at step S6 in the processing of FIG. 4). Further, the similarity index value R of the fragment Ss2[6] of the sub music piece M2 calculated with respect to the fragment Sm[4] of the main music piece is the maximum similarity index value Rmax, which is greater than the threshold value TH. Thus, the tone data As2[6] corresponding to the fragment Ss2[6] of the sub music piece M2 is output to the output device 30 in place of the tone data Am[4] of the fragment Sm[4] of the main music piece.

In the instant embodiment, as described above, some of the fragments Sm constituting the main music piece are replaced with the fragments Ss of the plurality of sub music pieces which are similar in musical character to the fragments Sm of the main music piece. Thus, even where the user is not familiar with similarity and harmoniousness of the individual music pieces, the instant embodiment can produce an auditorily-natural music piece without impairing the tune of the main music piece. Further, because each music piece is segmented into fragments S each corresponding to one or more beats (i.e., using one or more beats as a segmentation unit) and some of the fragments Sm of the main music piece are replaced with fragments Ss, similar to the fragments Sm, of the sub music pieces after the fragments Ss have been adjusted (at step S6 in the processing of FIG. 4) to the time lengths of the fragments Sm of the main music piece, the instant embodiment can reliably prevent impairment of the rhythm of the man music piece.

Figure 6:
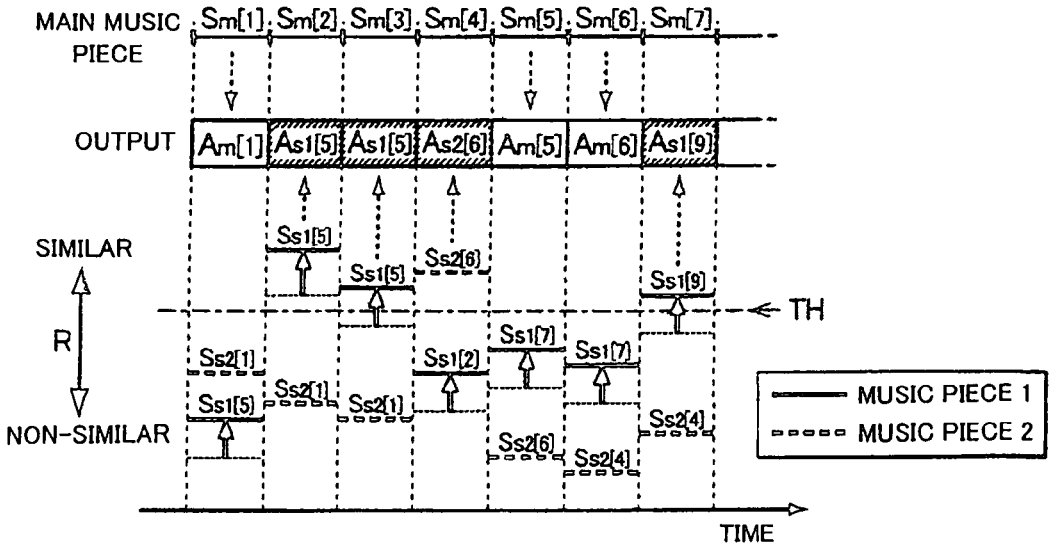
FIG. 6 is a conceptual diagram showing relationship between the similarity index values and the outputs from the control device.

FIG. 6 shows a case where the coefficient C of the sub music piece M1 shown in FIG. 5 has been increased in value by the user moving the corresponding operating member 56 displayed on the display device 50. As indicated by white arrows in FIG. 6, increasing the value of the coefficient C of the sub music piece M1 increases the similarity index values R, calculated for the individual fragments Ss1 of the sub music piece M1, as compared to those shown in FIG. 5. Therefore, although the similarity index value R (maximum similarity index value Rmax) indicative of a degree of similarity between the fragment Sm[3] of the main music piece and the fragment Ss1[5] of the sub music piece M1 is smaller than the threshold value TH in the case of FIG. 5, that similarity index value R is increased to a value greater than the threshold value TH in the case of FIG. 6. As a consequence, for the fragment Sm[3] of the main music piece, the tone data As1[5] of the fragment Ss1[5] of the sub music piece M1 is output in place of the tone data Am[3] of the main music piece. Similarly, for the fragment Sm[7] of the main music piece, the tone data As1[9] of the sub music piece M1 is output in place of the tone data Am[7] of the main music piece because the similarity index value R of the fragment Ss1[9] of the sub music piece M1 is increased to a value greater than the threshold value TH.

The preferred embodiment has been described above in relation to the case where the coefficient C is increased. In case the coefficient C of a given sub music piece has been decreased, the similarity index values R calculated for the individual fragments Ss of the given sub music piece decrease, so that the possibility of the tone data As of the sub music piece being output to the output device 30 will decrease. If the operating member 56 corresponding to the sub music piece M1 has been moved to the lower end of the corresponding operating member image section 54, for example, then the coefficient C is set at zero, so that all of the similarity index values R calculated for the individual fragments Ss1 of the sub music piece M1 become zero; consequently, none of the tone data As1 of the sub music piece M1 will be output to the output device 30.

In the above-described embodiment, a frequency at which fragments Sm of a main music piece are replaced with fragments Ss of a given sub music piece increases or decreases by the coefficient C of the sub music piece being increased or decreased in response to user's operation on the input device 40. As a consequence, the instant embodiment can organize a variety of music pieces corresponding to user's preferences in contrast to the case where the coefficient C is fixed in value (or the case where the similarity index value R0 calculated by the similarity determination section 12 is output as-is to the processing section 18). Besides, because the coefficients C of individual sub music pieces are adjustable in response to movement of the operating members 56 emulating sliders in the instant embodiment, the embodiment advantageously allows the user to intuitively identify any sub music piece output in priority to a main music piece.

B. Modification:

The present invention should not be construed as limited to the above-described embodiment, and various modifications of the invention are also possible as follows without departing from the basic principles of the invention; also, the following modifications may be combined as appropriate.

(1) Modification 1:

The preferred embodiment has been described above as processing or replacing a fragment Sm of a main music piece with any one of fragments Ss of sub music pieces whose similarity index value R is greater than the threshold value TH. However, the way to select a fragment Sm of a main music piece to be processed is not limited to the aforementioned. For example, each fragment Sm to be excluded from the processing of the main music piece (i.e., each fragment Sm to be not processed) may be designated by the user operating the input device 40. Namely, in this case, the processing section 18 makes a determination, during a time period from step S1 to step S3 of FIG. 4, as to whether any target fragment Sm has been designated by the user. If any of the fragments of the main music piece has been designated as a "not-to-be-processed fragment", the corresponding tone data Am of the main music piece is output irrespective of the similarity index value R, while, if no such not-to-be-processed fragment has been designated, the processing section 18 performs the aforementioned operations at and after step S3 of FIG. 4. With this modification, it is possible to realize such reproduction in which tone data of fragments Sm of a main music piece are output as-is for, for example, first and third beats of each measure of the main music piece. Thus, this modification can reliably maintain the tune of the main music piece.

(2) Modification 2:

Whereas the preferred embodiment and modification 1 have been described as replacing a fragment Sm of a main music piece with any one of fragments Ss of sub music pieces, the way to process a main music piece on the basis of sub music pieces is not limited to replacement of the fragment Ss. For example, tone data Am of a fragment Sm of a main music piece and tone data As of one or more fragments Ss of one or more sub music piece which has been determined to be similar to the fragment of the main music piece may be mixed at a predetermined ratio, and thereafter the mixed tone data may be output. However, the aforementioned construction of merely replacing a fragment Sm of a main music piece with a fragment Ss of a sub music piece as set forth above can achieve the advantageous benefit that the processing load on the control device 10 can be effectively lessened.

Further, whereas the preferred embodiment and the modifications have been described as processing a fragment Sm of a main music piece with a fragment Ss presenting a maximum similarity index value Rmax, the way to select a fragment Ss to be used for processing of the main music piece may be modified as appropriate. For example, where similarity index values R of a plurality of fragments Ss exceed the threshold value TH, tone data Am of a fragment Sm of a main music piece may be replaced with tone data obtained by mixing tone data As of all or a predetermined number of these fragments Ss; alternatively, the tone data As of all or a predetermined number of the fragments Ss, of which the similarity index values R exceed the threshold value TH, may be mixed so that the mixed tone data are output. Further, although the threshold value TH has been described above as a preset fixed value, there may be employed an alternative arrangement where the threshold value TH is variably set in response to user's operation on the input device 40.

Further, whereas the preferred embodiment and the modifications have been described as processing tone data Am of a target fragment Sm of a main music piece on the basis of a fragment of a sub music piece other than the main music piece, the target fragment Sm may be processed on the basis of another fragment of the main music piece than the target fragment Sm.

(3) Modification 3:

Whereas the preferred embodiment and the modifications have been described above as multiplying the similarity index value R0 by the coefficient C, the content of the calculation based on the coefficient C may be modified as appropriate. For example, the adjustment section 16 may set a sum of the coefficient and similarity index value R0 as the similarity index value R. Namely, it is only necessary that the similarity index value R be changed in accordance with the coefficient C, and the specific content of the arithmetic operation to be performed does not matter. However, with the aforementioned construction where the similarity index value R0 is multiplied by the coefficient C, there can be achieved the advantageous benefit that any fragments Ss of sub music pieces that are not similar to a fragment Sm of a main music piece can be reliably determined to be "non-similar", i.e. can be reliably prevented from being output, because, in such a case, the similarity index value R of each of the "non-similar" fragments is set at zero by the coefficient C being set at zero. Note that the arrangement for changing the similarity index value R in accordance with the coefficient C is not necessarily essential to the present invention; that is, the similarity index value R0 calculated by the similarity determination section 12 may be supplied directly to the processing section 18.

(4) Modification 4:

Similarity index value R may be calculated from character values Fm of a fragment Sm of a main music piece and character values Fs of a fragment Ss of a sub music piece in any desired manner. For example, although the similarity index value R has been described above as increasing as the degree of similarity between a fragment Sm of a main music piece and a fragment Ss of a sub music piece increases, it may be a numerical value that decreases as the degree of similarity between a fragment Sm of a main music piece and a fragment Ss of a sub music piece decreases.

Furthermore, any desired types and any desired number of the character values F may be included in the fragment data Ds. However, in the case where each music piece is segmented into fragments S each corresponding to one or more beats (i.e., using one or more beats as a segmentation unit) as set forth above, it is desirable that a fragment Ss of a sub music piece be selected to be used for processing of a main music piece on the basis of a tone characteristic, like that of a percussion musical instrument (typically, character values explained above in relation to the preferred embodiment and modifications), that determines rhythmic characteristics, rather than on the basis of a character of a tone pitch, harmoniousness (chord) or other similar factor.

(5) Modification 5:

Whereas the preferred embodiment and the modifications have been described above as using only fragments belonging to the loops of individual music pieces, it is not necessarily essential that the music pieces used in the music-piece processing apparatus 100 be limited to such loops alone. Namely, there may be employed a construction where fragment data Ds for respective entire parts (i.e., from the beginning to end) of music pieces are stored in the storage device 20. Therefore, the present invention is not limited to the above-described construction where only the loop of a main music piece is reproduced repetitively, and it may be constructed in such a manner that a main music piece is sequentially reproduced from the beginning to end thereof while being subjected to processing based on fragments Ss of sub music pieces. However, with the above-described construction where only the loop of each music piece is used, the present invention can advantageously produce a music piece, fitting a user's intention, using only user-preferred portions of music pieces.

(6) Modification 6:

Each of the numerical values corresponding to the N types of character elements included in the character values F may be separately weighted, in which case weighting values to be applied to the individual character elements may be set in response to user's operation of the input device 40. In this modification, the similarity index value R0 is calculated so as to take a greater value (i.e., indicate a higher degree of similarity) as the character values Fm and the character values Fs are closer to each other in terms of a predetermined one of the N types of character elements to which is applied a relatively great (or greatest) weighting value. With such a modification, it is possible to produce a music piece having preferentially reflected therein an aspect (character amount F) to which the user attaches a greatest musical importance.

(7) Modification 7:

The function for adjusting the time length of a fragment Ss of a sub music piece at step S6 of FIG. 4 may also be used for adjustment of a tempo of an entire music piece. In this modification, a tempo may be selected in response to user's operation on the input device 40.

(8) Modification 8:

Harmony information indicative of a harmony feeling (or harmonic characteristic) of a tone, such as HPCP (Harmonic Pitch Class Profile) information, may be included as a character value Fm or Fs of each fragment Sm or Ss. In such a case, there may be further provided a chord-sequence extraction section 17 (or program),as shown in FIG. 1, that generates chord sequence data by automatically detecting, from the harmony information, a chord progression of the music piece. The chord-sequence extraction section may detect a chord sequence (chord progression) of only a main music piece, or chord sequences (chord progressions) of both a main music piece and each sub music piece. For example, the detected chord sequence may be used to determine a width of a portion of a main music piece suited for replacement. In this case, a replaceable-portion determination section 19 (or program) may be further provided, as shown in FIG. 1, so that chord sequence data indicative of a chord progression is generated by the replaceable-portion determination section on the basis of the harmony information included in the character values Fm of the fragment Sm of the main music piece; here, a particular portion of the chord sequence data where a chord does not vary (i.e., a portion extending over, or corresponding to, ¼ beat, ½ beat, one beat, a plurality of beats, one measure or a plurality of measures where a same chord is maintained) is determined as a replaceable portion. Then, the processing section 18 processes, per replaceable portion thus determined, fragment data on the basis of a result of comparison by the comparison section 12. For example, for a given replaceable portion, one or a plurality of successive fragments Sm of the main music piece are replaced with one or a plurality of successive fragments Ss of a sub music piece which are most similar to the one or plurality of successive fragments Sm of the main music piece. As an alternative, chord sequence data, indicative of a chord progression of each sub music piece, may be generated on the basis of the harmony information included in the character values Fs of the fragments Ss of the sub music piece, and the comparison section 12 may determine a portion partly similar to the chord progression of the main music piece from among the chord progressions of the individual sub music pieces and then output a result of comparison corresponding to the determined portion.

(9) Modification 9:

Although the preferred embodiment and the modifications have been described above as processing a main music piece by the control device 10 executing software programs, the music-piece processing apparatus 100 may also be implemented by hardware (electronic circuitry), such as a DSP, performing processing similar to that performed by the control device 10 of FIG. 1.

This application is based on, and claims priority to, JP PA 2006-311325 filed on 17 Nov. 2006 and JP PA 2007-072375 filed on 20 Mar. 2007. The disclosure of the priority applications, in its entirety, including the drawings, claims, and the specification thereof, is incorporated herein by reference.

What is claimed is:

1. A music-piece processing apparatus comprising:

a storage section that stores respective music piece data sets of a plurality of music pieces, each of the music piece data sets comprising respective tone data of a plurality of fragments of the music piece and respective character values of the fragments, the character value of each of the fragments being indicative of a musical character of the fragment;

a designation section that designates, from among the plurality of music pieces stored in said storage section, one music piece as a main music piece and one or more music pieces as sub music pieces;

a comparison section that compares the character value of each of the fragments of the main music piece designated by said designation section and the character value of each individual one of the fragments of the one or more sub music pieces designated by said designation section, wherein said comparison section calculates a similarity index value indicative of a degree of similarity, to the character value of each of the fragments of the main music piece, of the character value of each individual one of the fragments of the one or more sub music pieces;

a processing section that, on the basis of results of the comparison by said comparison section, processes the tone data of each of the fragments of the main music piece on the basis of the tone data of any one of the fragments, similar in character value to the fragment of the main music piece, of the designated one or more sub music pieces, wherein said processing section determines, on the basis of the similarity index value calculated by said comparison section, similarity between the character value of each of the fragments of the main music piece and the character value of each individual one of the fragments of the one or more sub music pieces, and said processing section processes the tone data of a given one of the fragments of the main music piece on the basis of the tone data of any one of the fragments of the sub music pieces which has been determined to be similar to the given fragment; and a coefficient setting section that sets a coefficient for each of the one or more sub music pieces in response to operation by a user, wherein said comparison section includes an adjustment section that adjusts the similarity index values, calculated for the fragments of each of the sub music pieces, in accordance with the coefficient set by said coefficient setting section for the sub music piece, and said processing section determines, on the basis of the similarity index values adjusted by said adjustment section, similarity between the character value of each of the fragments of the main music piece and the character value of each individual one of the fragments of the one or more sub music pieces.

2. A music-piece processing apparatus as claimed in claim 1 wherein each of the fragments is a segment obtained by segmenting the music piece at a time point thereof synchronized with a beat.

3. A music-piece processing apparatus as claimed in claim 1 wherein said processing section processes the tone data of each of the fragments of the main music piece in such a manner that the tone data of a given one of the fragments of the main music piece is replaced with the tone data of any one of the fragments of the sub music pieces which has been determined to be similar to the given fragment of the main music piece.

4. A music-piece processing apparatus as claimed in claim 3 wherein said processing section processes the tone data of the one of the fragments of the sub music pieces, which should replace the given fragment of the main music piece, so as to have a time length substantially equal to a time length of the given fragment of the main music piece.

5. A music-piece processing apparatus as claimed in claim 1 wherein said processing section mixes together the tone data of each of the fragment of the main music piece and the tone data of any one or more of the fragments, having been determined to be similar to the fragment of the main music piece, of the one or more sub music pieces.

6. A music-piece processing apparatus as claimed in claim 1 wherein a sound waveform of each of the music pieces is segmented into a plurality of time sections, and the tone data of each of the fragments comprises waveform data of one of the segmented time sections.

7. A music-piece processing apparatus as claimed in claim 1 wherein the character value, indicative of the musical character, stored in said storage section for each of the fragments comprises respective character values of a plurality of types of character elements.

8. A music-piece processing apparatus as claimed in claim 7 wherein said plurality of types of character elements include energy, centroid of a frequency-amplitude spectrum, frequency presenting maximum spectral intensity and MFCC of a sound.

9. A music-piece processing apparatus as claimed in claim 7 wherein said comparison section determines, with the character values of N types of the character elements taken into account, similarity between the fragment of the main music piece and each individual one of the fragments of the sub music pieces, where N represents a variable number.

10. A music-piece processing apparatus as claimed in claim 7 wherein said comparison section expresses, in N-dimensional coordinates, each of the character values of the N types of the character elements for each of the main music piece and sub music pieces, and outputs, for each of the sub music pieces, an index value based on a distance of an N-dimensional coordinate position of the sub music piece to an N-dimensional coordinate position of the main music piece as data indicative of a degree of similarity of the sub music piece to the main music piece, where N represents a variable number.

11. A music-piece processing apparatus as claimed in claim 7 which further comprises a weighting setting section that individually sets weighting, as desired by a user, for each of the plurality of character elements, and wherein said comparison section makes the comparison using the character values weighted by said weighting setting section for each of the character elements.

12. A music-piece processing apparatus as claimed in claim 1 which further comprises a second designation section that designates any of the fragments of the main music piece, and wherein said processing section does not process the fragment designated by said second designation section from among the plurality of fragments of the main music piece.

13. The music-piece processing apparatus as claimed in claim 1 wherein said coefficient setting section includes a display visually indicating a setting amount of the coefficient set for each of the one or more sub music pieces so as to allow comparison between the setting amounts of the one or more sub music pieces.

14. A music-piece processing apparatus comprising:

a storage section that stores respective music piece data sets of a plurality of music pieces, each of the music piece data sets comprising respective tone data of a plurality of fragments of the music piece and respective character values of the fragments, the character value of each of the fragments being indicative of a musical character of the fragment;

a designation section that designates, from among the plurality of music pieces stored in said storage section, one music piece as a main music piece and one or more music pieces as sub music pieces;

a comparison section that compares the character value of each of the fragments of the main music piece designated by said designation section and the character value of each individual one of the fragments of the one or more sub music pieces designated by said designation section, wherein said comparison section calculates a similarity index value indicative of a degree of similarity, to the character value of each of the fragments of the main music piece, of the character value of each individual one of the fragments of the one or more sub music pieces;

a processing section that, on the basis of results of the comparison by said comparison section, processes the tone data of each of the fragments of the main music piece on the basis of the tone data of any one of the fragments, similar in character value to the fragment of the main music piece, of the designated one or more sub music pieces, wherein said processing section determines, on the basis of the similarity index value calculated by said comparison section, similarity between the character value of each of the fragments of the main music piece and the character value of each individual one of the fragments of the one or more sub music pieces, and said processing section processes the tone data of a given one of the fragments of the main music piece on the basis of the tone data of any one of the fragments of the sub music pieces which has been determined to be similar to the given fragment; and a coefficient setting section that sets a coefficient for each of the one or more sub music pieces in response to operation by a user, wherein said comparison section includes an adjustment section that adjusts the similarity index values, calculated for the fragments of each of the sub music pieces, in accordance with the coefficient set by said coefficient setting section for the sub music piece, said processing section determines, on the basis of the similarity index values adjusted by said adjustment section, similarity between the character value of each of the fragments of the main music piece and the character value of each individual one of the fragments of the one or more sub music pieces, and in the music piece data stored in said storage section, harmony information, indicative of a harmonic characteristic of a tone, is included for each of the fragments as a character value indicative of a musical character of the fragment, which further comprises a chord-sequence extraction member that generates chord sequence data of at least the main music piece by automatically detecting, from the harmony information of at least the main music piece, a chord progression of the main music piece, and a determination section that determines, as a replaceable portion, a portion of the chord sequence data of at least the main music piece where a same chord is maintained, and wherein, per replaceable portion determined by said determination section, where said processing section processes fragment data for said replaceable portion determined by said determination section, said processing section processes fragment data on the basis of a result of comparison by said comparison section.

15. A method of for processing a music-piece using a storage section that stores respective music piece data sets of a plurality of music pieces, each of the music piece data sets comprising respective tone data of a plurality of fragments of the music piece and respective character values of the fragments, the character value of each of the fragments being indicative of a musical character of the fragment, said method comprising:

a step of designating, from among the plurality of music pieces stored in said storage section, one music piece as a main music piece and one or more music pieces as sub music pieces;

a step of comparing the character value of each of the fragments of the main music piece designated by said step of designating and the character value of each individual one of the fragments of the one or more sub music pieces designated by said step of designating, wherein said step of comparing calculates a similarity index value indicative of a degree of similarity, to the character value of each of the fragments of the main music piece, of the character value of each individual one of the fragments of the one or more sub music pieces;

a step of, on the basis of results of the comparison by said step of comparing, processing the tone data of each of the fragments of the main music piece on the basis of the tone data of any one of the fragments, similar in character value to the fragment of the main music piece, of the designated one or more sub music pieces, wherein said step of processing determines, on the basis of the similarity index value calculated by said step of comparing, similarity between the character value of each of the fragments of the main music piece and the character value of each individual one of the fragments of the one or more sub music pieces, and said step of processing processes the tone data of a given one of the fragments of the main music piece on the basis of the tone data of any one of the fragments of the sub music pieces which has been determined to be similar to the given fragment; and a step of setting a coefficient for each of the one or more sub music pieces in response to operation by a user, wherein said step of comparing includes a step of adjusting the similarity index values, calculated for the fragments of each of the sub music pieces, in accordance with the coefficient set by said step of setting for the sub music piece, and said step of processing determines, on the basis of the similarity index values adjusted by said step of adjusting similarity between the character value of each of the fragments of the main music piece and the character value of each individual one of the fragments of the one or more sub music pieces.

16. The method as claimed in claim 15 wherein said step of setting includes visually indicating a setting amount of the coefficient set for each of the one or more sub music pieces so as to allow comparison between the setting amounts of the one or more sub music pieces.

17. A computer-readable storage medium containing a program for causing a computer to perform a music piece processing procedure using a storage section that stores respective music piece data sets of a plurality of music pieces, each of the music piece data sets comprising respective tone data of a plurality of fragments of the music piece and respective character values of the fragments, the character value of each of the fragments being indicative of a musical character of the fragment, said music piece processing procedure comprising:

a step of designating, from among the plurality of music pieces stored in said storage section, one music piece as a main music piece and one or more music pieces as sub music pieces;

a step of comparing the character value of each of the fragments of the main music piece designated by said step of designating and the character value of each individual one of the fragments of the one or more sub music pieces designated by said step of designating, wherein said step of comparing calculates a similarity index value indicative of a degree of similarity, to the character value of each of the fragments of the main music piece, of the character value of each individual one of the fragments of the one or more sub music pieces;

a step of, on the basis of results of the comparison by said step of comparing, processing the tone data of each of the fragments of the main music piece on the basis of the tone data of any one of the fragments, similar in character value to the fragment of the main music piece, of the designated one or more sub music pieces, wherein said step of processing determines; on the basis of the similarity index value calculated by said step of comparing, similarity between the character value of each of the fragments of the main music piece and the character value of each individual one of the fragments of the one or more sub music pieces, and said step of processing processes the tone data of a given one of the fragments of the main music piece on the basis of the tone data of any one of the fragments of the sub music pieces which has been determined to be similar to the given fragment; and a step of setting a coefficient for each of the one or more sub music pieces in response to operation by a user, wherein said step of comparing includes a step of adjusting the similarity index values, calculated for the fragments of each of the sub music pieces, in accordance with the coefficient set by said step of setting for the sub music piece, and said step of processing determines, on the basis of the similarity index values adjusted by said step of adjusting similarity between the character value of each of the fragments of the main music piece and the character value of each individual one of the fragments of the one or more sub music pieces.

18. The computer-readable storage medium as claimed in claim 17 wherein said step of setting includes visually indicating a setting amount of the coefficient set for each of the one or more sub music pieces so as to allow comparison between the setting amounts of the one or more sub music pieces.

* * * * *